United States Patent [19]

Kantor

[11] 4,345,347

[45] Aug. 24, 1982

[54] HEAD AND NECK SUPPORT CUSHIONS

[76] Inventor: Philip A. Kantor, 224 Gregory Ave., West Orange, N.J. 07052

[21] Appl. No.: 143,425

[22] Filed: Apr. 24, 1980

[51] Int. Cl.[3] ..... A47G 9/00

[52] U.S. Cl. ..... 5/441; 5/436

[58] Field of Search ..... 5/431, 432, 434, 435, 5/436, 438, 439, 437, 440, 441, 442; 297/391, 393; D6/201, 204

[56] References Cited

U.S. PATENT DOCUMENTS

| | | | |
|---|---|---|---|
| 2,336,707 | 12/1943 | Thompson | 5/436 |
| 3,312,987 | 4/1967 | Emery | 5/441 |

FOREIGN PATENT DOCUMENTS

| | | | |
|---|---|---|---|
| 1430355 | 1/1966 | France | 5/441 |
| 467637 | 12/1957 | Italy | 297/393 |
| 20360 | of 1901 | United Kingdom | 5/441 |
| 838455 | 6/1960 | United Kingdom | 297/393 |

*Primary Examiner*—Alexander Grosz

[57] ABSTRACT

A cushion designed to support the head and neck while the user is seated in a high-backed chair, passenger seat or hospital bed. The contour of the back of an average individual's head and neck is formed into the cushion, which is embodied in a medium firm enough to be the object of such forming and provide support, yet soft and pliable enough to adapt to the particular contour of the back of the head and neck of a particular individual.

A tubular stretch-knit sleeve, open at two ends, for covering any part of a crescent- or horseshoe-shaped cushion which touches the skin or hair.

An inflatable embodiment of the above head and neck support cushion made from a pre-formed vinyl upper half and a flat vinyl lower half, equipped with a valve and sealed.

The use of tiny weights in the tips of an inflatable, horseshoe- or crescent-shaped cushion to balance the cushion on the shoulders without resort to wide lateral support wings or a snug fit.

1 Claim, 13 Drawing Figures

FIG. 9
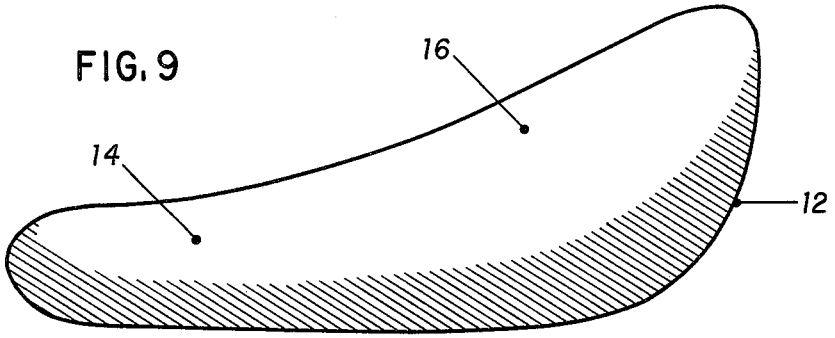
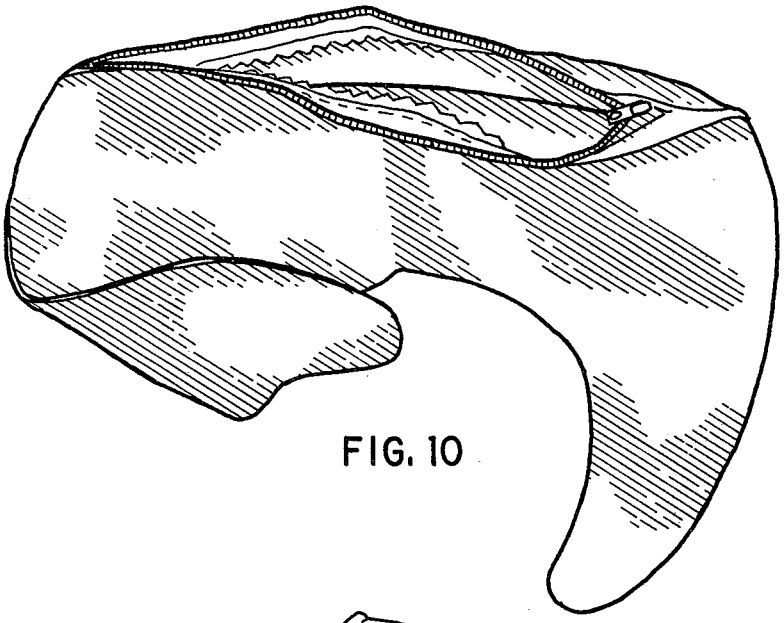
FIG. 10
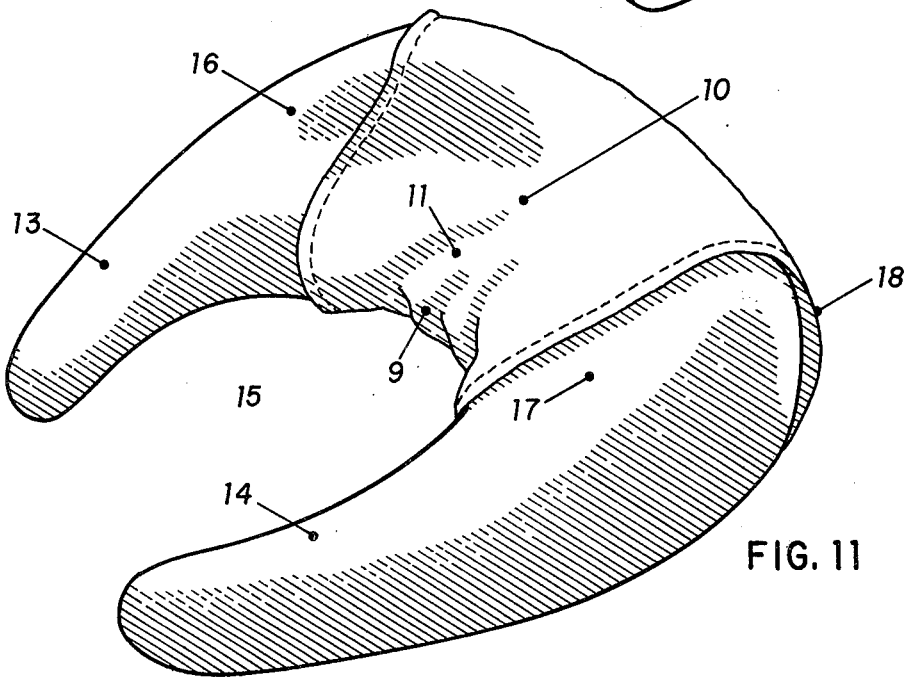
FIG. 11

HEAD AND NECK SUPPORT CUSHIONS

The human spine is "S"-shaped to facilitate man's erect posture when walking and standing (see FIG. 1). The spinal curves serve to transmit the weight of the otherwise unevenly balanced upper body to the sacrum (1), from which it may be directly supported with a minimum expenditure of muscular effort. Although the "S"-shaped configuration of the spine constitutes an adaptation to erect posture, the body seeks to maintain this curvature even when fully supported. For example, when reclining in bed, most people find it comfortable to keep the head slightly propped up by use of a bed pillow. Though bed pillows are easy to find, no pillow currently exists which can serve a similar function for the person relaxing or working in a high-backed chair, passenger seat, hospital bed or the like (see FIG. 2). Consequently, when a person is seated in any of these, the neck muscles most compensate for the lack of support to the head by contracting in a direction opposite to the pull of gravity so that the head will remain inclined slightly forward in the way that the body finds most comfortable. When a seated position is maintained for a long period of time, the muscles are continuously contracted, causing two types of injury and pain:

(1) The contracted muscle is pulling itself away from the blending point where it connects to the bone, eventually causing weakening, tenderness and inflammation in that area;

(2) The contracted muscle receives no oxygen and is unable to rid itself of harmful waste products (such as lactic acid), since these circulate only when the muscle is relaxed (this is muscular ischemia). Both of these conditions can be avoided by independently supporting the head in its natural, forwardly inclined posture, thus eliminating the need for sustained muscular contraction.

Conventional stuffed, foam or inflatable pillows (see FIG. 3) do not provide the needed support because they bulge outward in the middle (2), pushing the head far forward of its natural posture. The neck muscles react by "fighting back" to bring the head into line with the natural lordotic curve, resulting in the pain-producing conditions described above. Small and narrow pillows provide little support and are troublesome because they constantly shift about.

Neck support cushions (see FIG. 4), tubular or nearly tubular in shape and designed to fill in the gap between the back of the neck and the chair, curve in below the head (3) and allow it to drop backward without providing any supplementary support. The symmetric, tubular shape of these pillows make them easy to manufacture, but unfortunately, the human anatomy does not conform to a symmetrical contour. Not only do these pillows fail to bulge high enough to support the head, but their symmetrical configuration causes them to bulge downward as far as they bulge upward (4), so that they wedge themselves between the back and the chair, shoving the shoulders uncomfortably forward. For example, see U.S. Pat. No. 98,859 Fast; U.S. Pat. No. 2,328,871 Woehler; U.S. Pat. No. 3,312,987 Emery; U.S. Pat. No. 3,667,074 Emery; U.S. Pat. No. 4,161,794 Darnfors; U.K. Pat. No. 248.635; French Pat. No. 1.076.118; French Pat. No. 1.430.355; Australian Pat. No. 283.611.

Even those "neck support" pillows which are not simply tubular, including those with supplementary pillows, corner pillows, "squared" tubular pillows or pillows of varying diameter, must fail if they do not support the head. See U.S. Pat. No. 673,872 von Hillern-Flinsch; U.S. Pat. No. 1,787,832 Mueller; U.S. Pat. No. 2,336,707 Thompson; U.S. Pat. No. 2,522,120 Kaskey et al.

Cushions do appear in the prior art which make accomodation for the head. This is effected by allowing a bulge for the neck and a depressed area or hole for the head. Most of these appear in the field of "sleep" pillows, however, and do not aid in the health and comfort of the upright or semi-reclining user. For example, see U.S. Pat. No. 2,880,428 Forsland; U.S. Pat. No. 3,521,310 Greenwalt; U.K. Pat. No. 610.415; U.K. Pat. No. 1.299.925; French Pat. No. 1.192.403; French Pat. No. 2.305.956; Canadian Pat. No. 569.458; German Pat. No. 2.253.330.

The few designed for the upright user are heavy and cumbersome, and do not employ a continuous contour following that of the human anatomy, such as U.K. Pat. No. 385.694; U.K. Pat. No. 414.131. The inflatable variety, with "butterfly" wings, uses complicated seams and provides only crude support, see U.S. Pat. No. 3,017,221 Emery. The strictly lateral support pillows provide no rear head and neck support at all, such as U.S. Pat. No. 4,031,578 Sweeney et al.

One object of my invention (See FIG. 5) is to provide the rear head and neck support (5) lacking in the prior art. Another object of my invention is to provide this support in the most efficient way, excluding all extraneous weight, bulk and accessories. Additionally, in the preferred horseshoe-shaped embodiment (6), my invention can remain in a useful position even when the user shifts about and provides moderate lateral support for the head during napping. Finally, through my invention, all of the above can be accomplished in inexpensive media with minimal manufacturing and assemblage costs; for example, in an inflatable embodiment, which was heretofore impossible.

The novelty of this new head and neck support means lies firstly in the selection of a medium firm enough to be permanently shaped according to the contour of the back of an average individual's head and neck and provide support, yet soft and pliable enough to be comfortable and conform to the contour of the back of a particular individual's head and neck and to the angle of the chair back on which he is sitting. It is a further aspect of this invention to form the selected medium into a cushion at least high enough, from top to bottom, to equal the distance between the top of the shoulders (7) and the lower head towards the occipital ridge (8) of the average user for whom the support is intended. In the preferred embodiment, the medium is formed into a horseshoe-shaped cushion, the middle portion of which must be of the minimum height as described in the previous sentence. A third step in my invention is to form, permanently, into one side of the cushion or into the middle portion (interior) of the horseshoe-shaped cushion, the contour of the back of the average user's head and neck, from the top of the shoulders towards the occipital ridge, in the natural, forwardly inclined posture which the body finds most comfortable when seated.

An examination of the accompanying drawings will further explain this novel head and neck support cushion:

FIG. 9 is a side view of the embodiment in FIG. 7.

FIG. 10 is a possible full cloth cover with zipper.

FIG. 11 is a perspective view of the embodiment in FIG. 7 outfitted with a tubular cover-sleeve.

Figure 1:
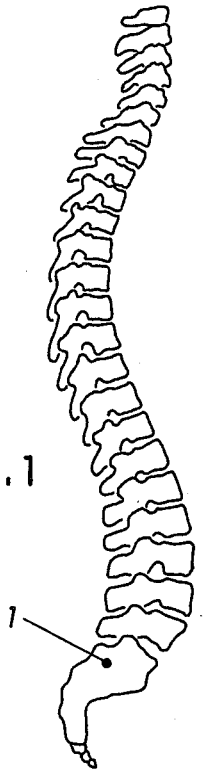
FIG. 1 illustrates the "S"-shaped curvature of the human spine.
Figure 2:
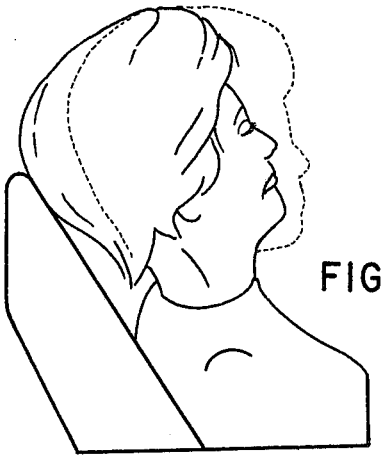
FIG. 2 is a profile view of a person seated in a high-backed chair without supplementary support to the head and neck.
Figure 3:
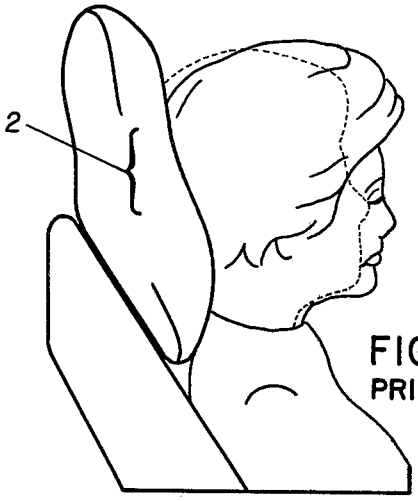
FIG. 3 PRIOR ART
FIG. 3 is a profile view of a person as in FIG. 2 with the head and neck improperly supported by a conventional pillow.
Figure 5:
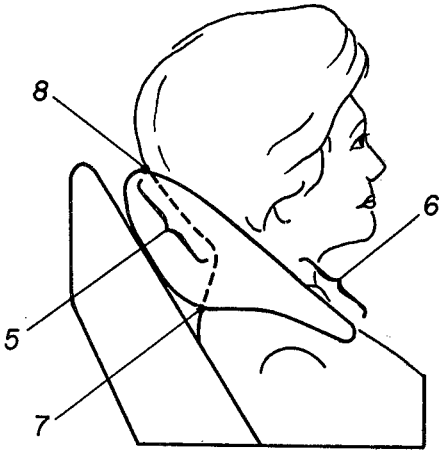
FIG. 5 is a profile view of a person as in FIG. 2 with the head and neck properly supported by the instant invention as depicted in FIG. 12.
Figure 4:
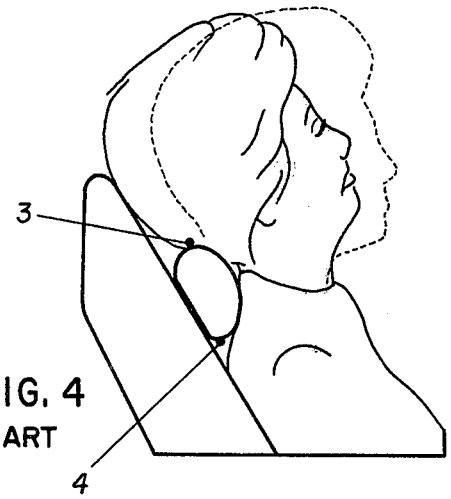
FIG. 4 PRIOR ART
FIG. 4 is a profile view of a person as in FIG. 2 with the head and neck inadequately supported by a tubular neck support cushion.
Figure 6:
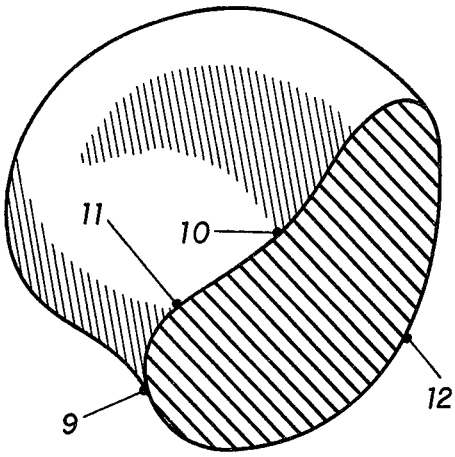
FIG. 6 is a perspective view of a solid embodiment of the head and neck support cushion which has been cut in half to show a cross-section of the contoured middle portion.
Figure 7:
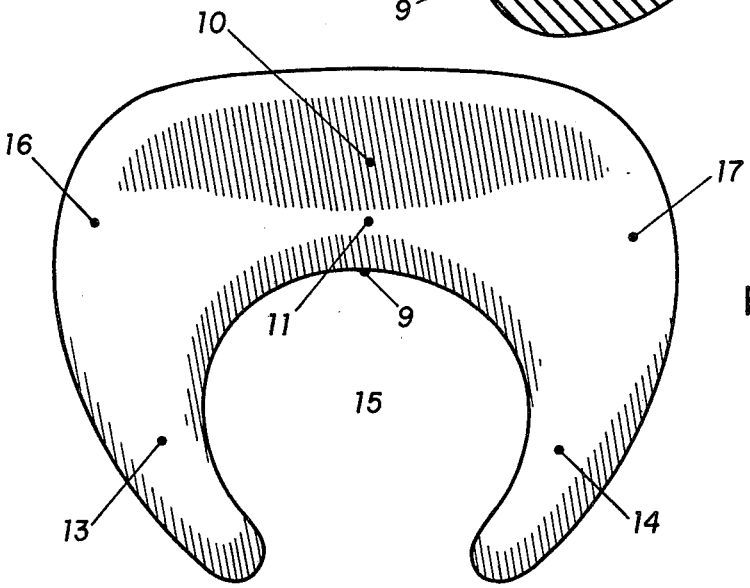
FIG. 7 is a top view of the head and neck support cushion as in FIG. 6 embodied in a solid medium in a horseshoe shape.
Figure 8:
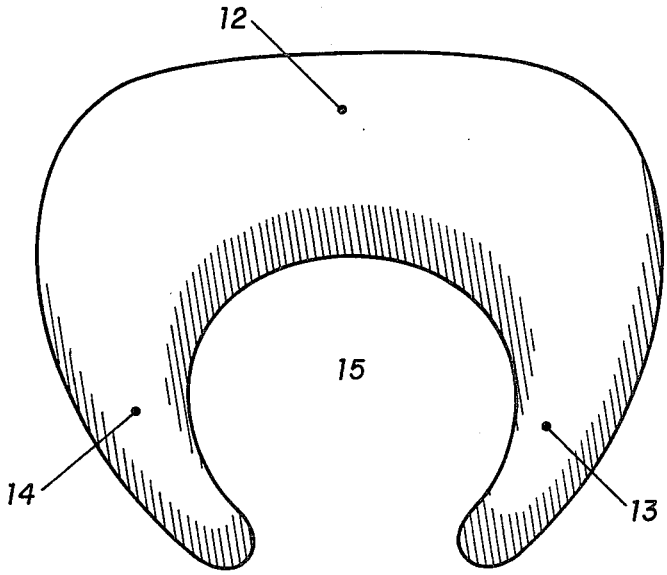
FIG. 8 is a bottom view of the embodiment in FIG. 7.
Figure 12:
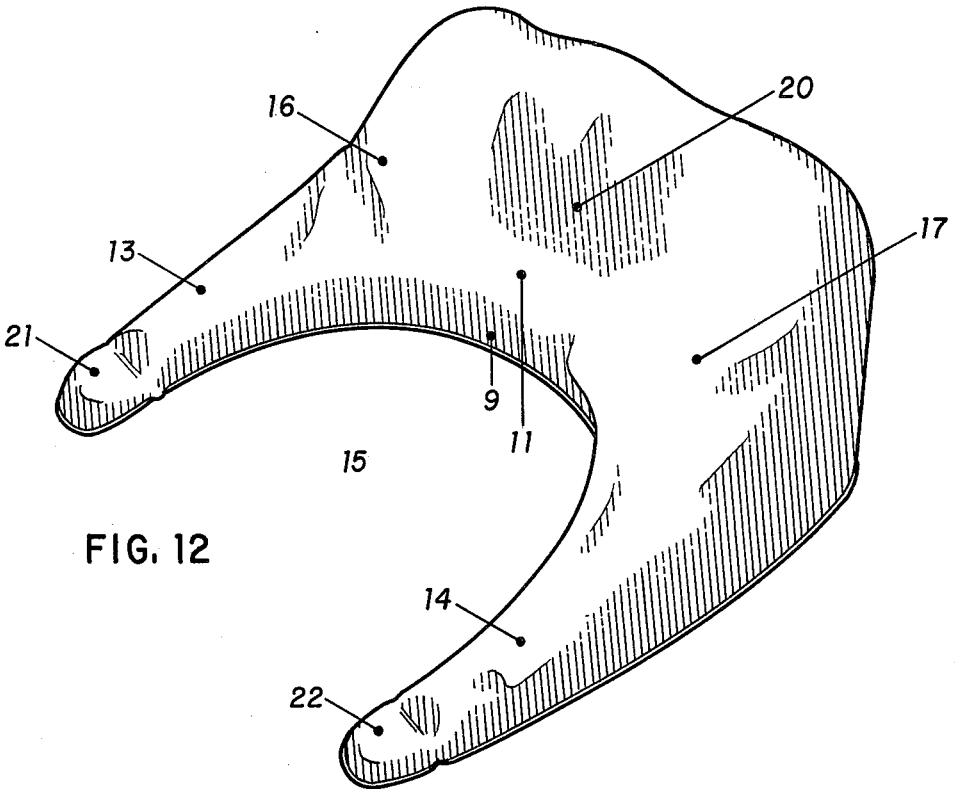
FIG. 12 is a perspective view of the head and neck support cushion in an inflatable embodiment.
Figure 13:
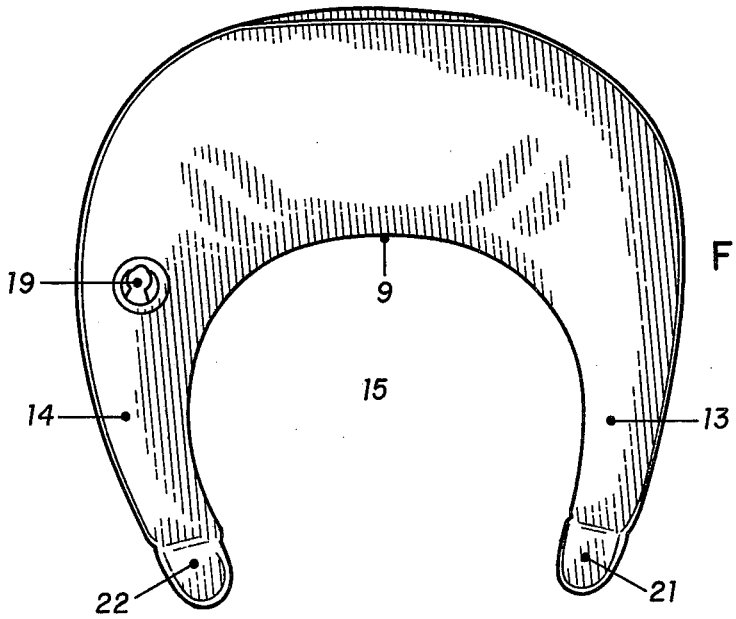
FIG. 13 is a bottom view of the embodiment in FIG. 12.

It can be observed that in all embodiments of the invention, there is a permanently contoured portion which includes two principle features: a moderate bulge (9) to support the neck by filling in the gap between it and the chair, and a depressed area (10) in which the head may nestle, fully supported without being pushed too far forward or allowed to slip too far backwards. This depressed area (10) is rather broad to allow the head a good deal of lateral freedom, so that the cushion never engenders a cloying sensation. The curve connecting these two areas (11) follows the contour of the back of an average user's head and neck during proper and healthy posture. This correct posture may be monitored in a variety of degrees of recline, because the position of the head vis a vis the rest of the back remains relatively unchanged. Consequently, once the cushion has been contoured for a particular group of users (children, adults, infants, etc.) in a particular sitting position, the contour will remain valid and the cushion effective despite application to new positions. It is to be expected that there will be variations in contour from user to user. However, once an approximate contour has been formed into cushion, even a vaguely approximate one, the pliability of the medium enables it to adjust to the variation. Similarly, the pliability of the medium in the exterior back of the cushion (12) can "give" to conform to variations in the angle at which the back of a chair or hospital bed rises. The result is perfect and effective support for a variety of users in a variety of situations, as if the cushion had been individually tailored to meet the exigencies of a particular person in a particular type of chair or bed.

The remainder of the horseshoe-shaped embodiment is composed of lateral support wings (13) and (14). Their chief purpose is to counterbalance the weight of the back portion of the cushion so that the whole cushion rests firmly on the shoulders, even when the user leans forward or rises from a seated position. The ability of the cushion to remain in place not only renders it less bothersome to the average user than conventional pillows, but is a boon to stroke victims and other extremely feeble persons who must call for assistance every time a conventional pillow slips out of place. Unlike other horseshoe- or crescent-shaped cushions, care has been taken to provide stability here through the use of *long* and *thin* lateral support wings rather than broad lateral support wings which hug the neck closely. It is the inventor's opinion that the area partially circumscribed by the cushion (15) ought to be large enough to accomodate the user's neck without touching the skin except in back, to allow for maximum air circulation. Consequently, stability is achieved here by the balancing of weight, not the snugness of fit.

The height of the cushion drops dramatically from the midsection to the lateral support wings (13) and (14) at the areas (16) and (17) so that the ears may be completely exposed and hearing remain unimpaired during use. The areas (16) and (17) can provide lateral support for the head should it fall to one side during drowsiness. The notion, occurring so often in the prior art, that the thickness present in (16) and (17) continue all the way out to the tips of the horseshoe for proper lateral support during drowsiness is unfounded. The chances of a drop of the head so far forward during napping are not great enough to justify the walled-in sensation of high lateral barriers. The lateral support wings (13) and (14) do, in any case, provide the important function of maintaining the cushion in place as the user shifts about.

The cushion may be covered entirely by a "pillowcase" tailored to fit its fairly complicated contours. It can be made out of any material which is pleasing when in contact with the skin and preferably absorbent or in some way able to carry off unwanted heat and perspiration, for example, cotton or polypropylene. There is no preferred mode of closure for such a pillowcase, so long as it is in the exterior back and out of contact with the skin. A zipper, as illustrated here, or snaps, buttons hook and pile type fastener such as the one sold under the trademark of Velcro, etc., will do.

A novel means of covering a crescent- or horseshoe-shaped pillow of this type is the use of a tubular stretch-knit sleeve (18). The advantages of such a sleeve over a more conventional cover are many:

(I) The use of a highly stretchable material allows for easy application of the cover to the cushion and removal thereof, and when applied, it will immediately assume the difficult contours of the instant invention without any stitching whatsoever, or it will assume the tubular shape of the conventional, prior art crescent-shaped pillows without wrinkles. The savings in labor costs are obviously massive.

(II) The use of an open-ended sleeve provides for maximum ease in applying and removing the cover for washing.

(III) Consistent with the concept of "minimalist" design, the sleeve (18) does not waste material by covering parts of the cushion which have no contact with the human skin.

(IV) Knit from the outset in tubular, i.e. three-dimensional form, the sleeve requires no lateral stitch at all, as would flat material, and needs only to be bound at the edges. Like the full-size cover, the sleeve (18) may be knit in any material pleasing to the human skin, absorbent and comfortable.

A major aspect of the instant invention disclosed here is the newfound means to embody it in inflatable form. Heretofore, it was thought that the only viable kind of inflatable cushion is that formed by die-cutting and sealing. In other words, all of the prior art inflatable cushions, whether conventional in shape (square, rectangular or circular, sealed around a peripheral seam), or tubular, are two-dimensional items inflated to become three-dimensional. This type of cushion is inferior to the instant invention in many respects.

Firstly, it cannot provide the user with an approximate contour in which to insert the head and neck. This is because air distributes itself symmetrically in all directions up to the confines of its container unless some outside force prevents it from doing so. Flat sheets, when inflated, simply bulge in symmetric fashion and cannot assume, except along the seams, any asymmetric shape. Of course, the contour of the back of the head and neck is asymmetric and can only be represented in the tubular pillows (used with the seam horizontally disposed) as an upward bulge and in the conventionally shaped pillows (used with the seams vertically disposed) as an outward bulge. Since the container (here, the flexible vinyl sheets) does not confine the air to a particular shape, the neck muscles must impose that shape from scratch by pushing the head and neck backwards to force air into other parts of the pillow. This "fight-back" is highly undesirable for proper posture and not very conducive to relaxation.

Secondly, in order to support the head up towards the occipital ridge, which is crucial for good posture, a cushion must be at least as high as the distance from the top of the shoulders to near the occipital ridge. The tubular inflatable cushions, designed to be used with the seam horizontally disposed, do not achieve the necessary height because they cannot do so. This is because the width of the tube restricts the height attainable through inflation. In order to obtain the ncessary height in such a pillow, its width would have to be so great that the user's head would be pushed far forward of the correct position. Conventionally shaped inflatable cushions, which are designed to be inserted behind the head with the seams vertically disposed, can achieve the necessary height, since the seams can be made to any height. But this results in loss of control over the horizontal dimension and the inflatable pillow bulges too far forward and backward, resulting in flexion, like the conventionally shaped solid pillows discussed earlier.

Thirdly, prior art inflatable cushions, formed by inflation of flat vinyl sheets, acquire numerous wrinkles in the process of being blown up to three dimensions. This is a fact of nature which cannot be avoided except by adding a supplementary layer of a more supple medium, such as a sheet of foam plastic in one prior art example. These wrinkles, if allowed to come into contact with the user, are quite bothersome, as they pinch the skin and wrinkle it in turn.

Finally, the designers of prior art horseshoe- and crescent-shaped inflatable cushions have engaged in a trade-off regarding the broadness of the lateral support wings and the tightness of their fit around the neck. On one hand, broad, snug-fitting lateral support wings keep the cushion from slipping off when the user leans forward or rises from a seated position (the broadened support wings are able to outweigh the back portion of the cushion and keep the whole balanced on the shoulders). On the other hand, the snug fit prevents air from circulating around the front and sides of the head and neck so that there is a very unpleasant accumulation of heat. This is compounded by the fact that inflated vinyl is an excellent insulator. The broadened lateral support wings add bulk to the cushion and aggravate the problem of heat build-up by insulating still more.

Each of these four problems has been completely overcome by the new kind of inflatable head and neck support cushion disclosed here. My novel inflatable cushion has a formed flexible vinyl top which solves the first three problems, viz. providing a built-in contour, achieving the necessary height for adequate support of the head and the avoidance of wrinkles when inflated. It is manufactured by taking a piece of flat vinyl and drape-forming it, through heat and vacuum suction, over a positive mold which has been carefully shaped to achieve the desired height and the contour of the back of the head and neck. An alternative method of manufacture would be to vacuum-form a piece of flat vinyl, through heat and vacuum suction, into a negative mold which has been carefully shaped to achieve the desired height and the contour of the back of the head and neck. In the process of forming, the heavy guage vinyl thins out in a fairly uniform manner to the desired end guage and assumes the shape of the mold. Upon removal from the mold, the formed sheet, which is still completely flexible, collapses into an irregular heap. Just as the prior art inflatable cushions, described above, acquired irregular, wrinkled surfaces when blown up to three dimensions, the formed vinyl sheet—a three-dimensional object—becomes irregular and wrinkled when reduced to "two dimensions". The formed vinyl top is then die-cut, together with a flat piece of vinyl equipped with a valve (19), and sealed around the edges.

Upon inflation of the cushion resulting from this process, the air distributes itself, as always, symmetrically throughout the confines of the vinyl. Now, however, the vinyl has shape apart from that defined by the seam. The use of drape-forming or vacuum-forming allows for a cushion which can achieve dramatic height on top with only a slight bulging at the bottom. Consequently, the head can be fully supported without the shoulders being shoved forward from the chair. Furthermore, the upper formed surface is free from wrinkles, because it was formed in three dimensions. Finally, the formed vinyl top embodies the contour of the back of the head and neck from the mold. It should be noted here that due to the flexibility of the medium, the depression for the head, which appears as (10) in the other embodiments, appears as a single large wrinkle (20) in the free-standing inflated embodiment. However, as soon as the head is inserted into the area, it is accomodated by the pre-formed contour. Because the latent contour exists in the formed vinyl top, far less pressure is required to insert the head and neck than in the prior art inflatable cushions.

The inflatable cushion disclosed here is best used when partially inflated. In this way, the cushion is more responsive to the variations in individual contours. Of course, the user may achieve an infinite range of firmness or softness by varying the degree of inflation to his individual taste. The inflatable embodiment can be outfitted with the same cover as any other embodiment.

The installation of tiny weights (21) and (22) in the tips of the lateral support wings (13) and (14) enables a horseshoe- or crescent-shaped cushion (inflatable) to rest securely on the shoulders notwithstanding the use of very narrow lateral support wings which are disposed quite far apart do not touch the head and neck at all in front or on the sides. The tiny weights counterbalance the large back portion of the cushion so that it does not drop backwards when the user rises from a seated position or slip off during normal use. As mentioned earlier, this represents a significant advantage, because the use of a widely disposed, narrow lateral support wings provides for maximum air circulation and eliminates bulk. Any type of benign weight will do the job, though our preference is for objects which concentrate much weight in a minimum of space and are sufficiently rounded that they will not pierce the vinyl. The combined weight of the two objects installed in the two wing tips should be slightly in excess of the weight of the inflated back portion of the cushion to insure maximum stability of the cushion on the shoulders. This is very little weight since the cushion is only filled with air and constitutes a negligeable inconvenience to the user in terms of portability and compactness of the cushion when not in use.

The weights are installed by outfitting the cutting and sealing die used to cut and seal the upper and lower halves of the cushion with two extra sealing bars to seal off tiny areas at the wing tips. The weights are then placed at the wing tips of one of the uncut, unsealed halves, and upon cutting and sealing, the weights are sealed off in their own little chambers at the wing tips so that they will always be properly positioned. Of course these areas will not later inflate, because they are sealed off from the rest of the cushion. But this does not in any way interfere with the cushion's function.

I claim:

1. An inflatable head and neck support cushion in a modified "horseshoe" shape, designed to rest on the shoulders of a person relaxing or working in a semi-reclining position in any hospital bed, passenger seat or high-backed chair; such that the head and neck are received by the interior middle portion of the "horseshoe", such middle portion permanently embodying the contour of the back of the head and neck of a person, the two tips of the "horseshoe" being long enough to extend over the shoulders of the person and widely enough disposed apart from one another so that there is unrestricted circulation of air to the sides of the neck and face of the person, the "horseshoe" tips containing at their extremities tiny weights, slightly heavier than the inflated middle portion of the "horseshoe", in order to stabilize the entire cushion on the shoulders of a person.

* * * * *